US006332511B1

(12) United States Patent
Parlato et al.

(10) Patent No.: US 6,332,511 B1
(45) Date of Patent: Dec. 25, 2001

(54) SILENCER ASSEMBLY HAVING SINGLE STRAND FIBERGLASS ACOUSTIC PACK MATERIAL

(75) Inventors: Michael P. Parlato, Elma, NY (US); James Dennis Stell, Wichita Falls, TX (US); Stephen Witt, Buffalo, NY (US)

(73) Assignee: Burgess-Manning, Inc., Orchard Park, NY (US)

( * ) Notice: Subject to any disclaimer, the term of this patent is extended or adjusted under 35 U.S.C. 154(b) by 0 days.

(21) Appl. No.: 09/455,693

(22) Filed: Dec. 7, 1999

(51) Int. Cl.[7] ..... G10D 1/02
(52) U.S. Cl. ..... 181/282; 181/272; 181/252
(58) Field of Search ..... 181/222, 252, 181/224, 256, 258, 255, 267, 249, 247, 248, 264

(56) References Cited

U.S. PATENT DOCUMENTS

| | | | | |
|---|---|---|---|---|
| 3,640,357 | | 2/1972 | Kitching et al. . | |
| 3,704,762 | | 12/1972 | Smith et al. . | |
| 3,715,009 | | 2/1973 | Smith et al. . | |
| 3,776,364 | | 12/1973 | Van Doeren . | |
| 4,105,089 | | 8/1978 | Judd . | |
| 4,180,141 | | 12/1979 | Judd . | |
| 4,316,522 | * | 2/1982 | Hirschorn | 181/224 |
| 4,433,751 | * | 2/1984 | Bonneau | 181/213 |
| 5,014,816 | | 5/1991 | Dear et al. . | |
| 5,101,930 | * | 4/1992 | Fargo et al. | 181/233 |
| 5,394,786 | | 3/1995 | Gettle et al. . | |
| 5,532,439 | | 7/1996 | Minkin . | |
| 5,828,759 | * | 10/1998 | Everingham | 381/71.5 |
| 5,859,393 | * | 1/1999 | Cummins, Jr. et al. | 181/287 |
| 6,089,348 | * | 7/2000 | Bokor | 181/272 |
| 6,109,387 | * | 8/2000 | Botetti | 181/230 |
| 6,116,376 | * | 9/2000 | Hu | 181/256 |

* cited by examiner

*Primary Examiner*—Robert E. Nappi
*Assistant Examiner*—Kim Lockett
(74) *Attorney, Agent, or Firm*—Simpson, Simpson & Snyder, PLLC

(57) ABSTRACT

A silencer assembly having a cylindrical chamber having a closed cylindrical outer wall, a first end wall and a second end wall, the first end wall having an inlet therein, and the second end wall having an outlet therein, an internal annular chamber proximate the cylindrical outer wall, the internal annular chamber bounded by the cylindrical outer wall and by a perforated cylindrical inner wall, the internal annular chamber containing single strand fiberglass acoustic fill material, the internal annular chamber having no internal barriers therein, and, a perforated generally cylindrically shaped core located inside of the cylindrical chamber positioned in spaced relation to the internal annular chamber and also in spaced relation to the inlet and outlet, creating a generally annular shaped passageway for exhaust gas, the core containing single strand fiberglass acoustic fill material.

4 Claims, 6 Drawing Sheets

SILENCER ASSEMBLY HAVING SINGLE STRAND FIBERGLASS ACOUSTIC PACK MATERIAL

FIELD OF THE INVENTION

This invention relates generally to noise silencers, more particularly to dissipative and combination reactive/dissipative noise silencers, and, even more particularly, to a silencer assembly containing single strand fiberglass acoustic pack material, and suitable for high velocity-high temperature gas flow applications.

BACKGROUND OF THE INVENTION

Exposure to excessive noise over an extended period may result in a permanent loss of hearing. Noise can also be hazardous as well as objectionable to nearby residents of an industrial plant. In the United States, industrial plants are legally responsible for worker safety, including control and abatement of excessive noise. One of the provisions of the Occupational Safety and Health Act (OSHA) of 1970 relates specifically to the occupational exposure of workers to noise. Under the Noise Control Act of 1972, the Environmental Protection Agency (EPA) was mandated by Congress to establish noise limits protective of public health and welfare with an adequate margin of safety. In addition to federal regulatory efforts, states and cities have set maximum noise levels acceptable at plant property lines. These levels typically vary according to area zoning—heavy industrial, commercial, residential and hospital. With tighter controls now in effect, every effort should be made to eliminate or measurably reduce noise at its source in a logical and systematic manner.

Ideally, the optimum approach to noise control is the prevention (or reduction) of noise at its source before it becomes a problem. However, equipment re-design and/or operational changes necessary to accomplish this are seldom possible.

Effective noise control is normally achieved by means of: (a) isolation, (b) dissipation or (c) a combination of the two. This involves the use and application of sound absorption materials, acoustic shields and barriers (fixed and movable), acoustic enclosures and/or silencers.

Typically, silencers are divided into three distinct categories: (a) the reactive "reflective type, (b) the dissipative "absorptive" type and (c) a combination of these two basic types. The present invention relates to dissipative and combination reflective/dissipative silencers.

The reactive-type silencer is generally restricted to relatively low-frequency applications, such as the intake and exhaust of engines, blowers and compressors. It is largely dependent upon an area discontinuity to reflect sound energy back to the source, and upon the dissipative effect of perforated, ported or slotted tubes for effective broad-band, low-frequency performance. Multi-chamber reactive silencers are available in: (a) straight-through tube arrangements for low-loss, pressure-drop applications and (b) in labyrinth-like, volume-tube configurations where pressure drop is not critical. Acoustic performance is a function of silencer diameter, overall volume and internal design. Absorptive material is not used in a pure reactive-type silencer.

The dissipative-type silencer is essentially a high-frequency, low-pressure drop attenuator. It depends on sound absorbing material to dissipate the sound energy and is usually applied on the intake and exhaust of centrifugal compressors, forced draft fans, gas turbines, steam or process vents and similar equipment. Dissipative silencers are usually straight runs of acoustically lined piping or parallel baffles. Performance depends upon the internal design and the type of absorptive material used. The open flow area ranges from 25 to 75 percent, depending upon the required attenuation and allowable pressure drop.

The acoustic fill in dissipative-type silencers is usually mineral wool, polyester, fiberglass or another durable, inert, vermin-proof, moisture-resistant material. For intake applications, the density of the acoustic fill is typically 2½ to 4 pounds per cubic foot packed under 10 percent compression to prevent voids. In exhaust service, the density is increased to a minimum of 6 pounds per cubic foot and, depending upon the temperature and unit velocity, the fill is normally protected with one or two wraps of fiberglass cloth or with one wrap of cloth and a stainless steel mesh screen, plus a perforated face sheet.

The combination reactive/dissipative silencer is functionally a reactive silencer with sound absorptive material to provide added high-frequency noise reduction. The perforated, slotted or ported tube applied to the reactive silencer acts as a dissipative element, reducing or eliminating troublesome pass-bands inherent to the basic reactive design. The performance of an effective reactive silencer is a result of both the dissipation and reflection of noise energy.

Silencer design is influenced to a large extent by intended use and application. The focus of this patent is an industrial silencing application where the velocity of the gas stream through the silencer is typically greater than 10,000 feet per minute and the temperature of the gas is usually greater than about 700° F. These operating conditions are typical when designing for high-pressure steam vent safety relief valve silencers and gas turbine engine silencers.

The industry standard for these "high-velocity/high-temperature" applications has been to use an acoustic pack material such as mineral or fiberglass wool that consists of a collection of small individual fibers wrapped in a protective fiberglass cloth or mesh wire. Typically, industrial silencers built for this type of high temperature—high flow application use a combination of an absorptive and reactive design to achieve the necessary noise reduction. Absorptive material is packed between the outer shell of the silencer and a perforated cylinder through which the gas flows. A barrier is then inserted into the flow path in order to redirect the gas flow to the perforated wall while the barrier dissipates the lower frequency sound waves. When the gas flow is redirected into the perforated cylinder, the higher frequency sound waves are absorbed by the acoustic material packed between the perforated cylinder and the outer shell of the unit.

While the above-described design has proven effective for noise reduction, a problem often occurs due to the high velocity and temperatures specific to these silencing applications. The typical absorptive material used for these applications often fragments due to the extreme gas velocity and temperature. There is thus a risk that the fragmented material will be expelled through the perforated holes into the gas stream. This fragmentation also results in a pack density much higher than intended, which can reduce the absorptive quality of the pack material. Finally, the fragmentation leads to a collapse of the material which leaves voids in the cavity that allow sound waves to pass through freely.

Applications involving high velocity—high temperature gas flows such as gas turbine engine silencers have always been vulnerable to pack migration as well. The common solution has been to modify the internal design of the unit and insert physical barriers to prevent the pack material from migrating or being expelled from the cavity. While this method has been successful in preventing the migration of the pack, the pack material is still vulnerable to fragmentation. The resulting "voids" in the cavity along with other changes in the internal design to reduce migration can affect the performance of the unit, which is critical when silencing a gas turbine engine.

What is needed, then, is a new silencer design for high velocity—high temperature gas flow applications that achieves suitable noise reduction and also prevents pack fragmentation and migration.

SUMMARY OF THE INVENTION

The invention broadly comprises a silencer assembly having a cylindrical chamber having a closed cylindrical outer wall, a first end wall and a second end wall, the first end wall having an inlet therein, and the second end wall having an outlet therein, an internal annular chamber proximate the cylindrical outer wall, said internal annular chamber bounded by said cylindrical outer wall and by a perforated cylindrical inner wall, the internal annular chamber containing single strand fiberglass acoustic fill material, the internal annular chamber having no internal barriers therein, and, a perforated generally cylindrically shaped core located inside of the cylindrical chamber positioned in spaced relation to the internal annular chamber and also in spaced relation to the inlet and outlet, creating a generally annular shaped passageway for exhaust gas, the core containing single strand fiberglass acoustic fill material.

A general object of the present invention is to provide a new silencer for high velocity high temperature gas flow applications that achieves suitable noise reduction and also prevents pack fragmentation and migration.

These and other objects, features and advantages of the present invention will become readily apparent to those having ordinary skill in the art in view of the following detailed description in view of the several drawing figures and appended claims.

DETAILED DESCRIPTION OF THE PREFERRED EMBODIMENT

Figure 1:
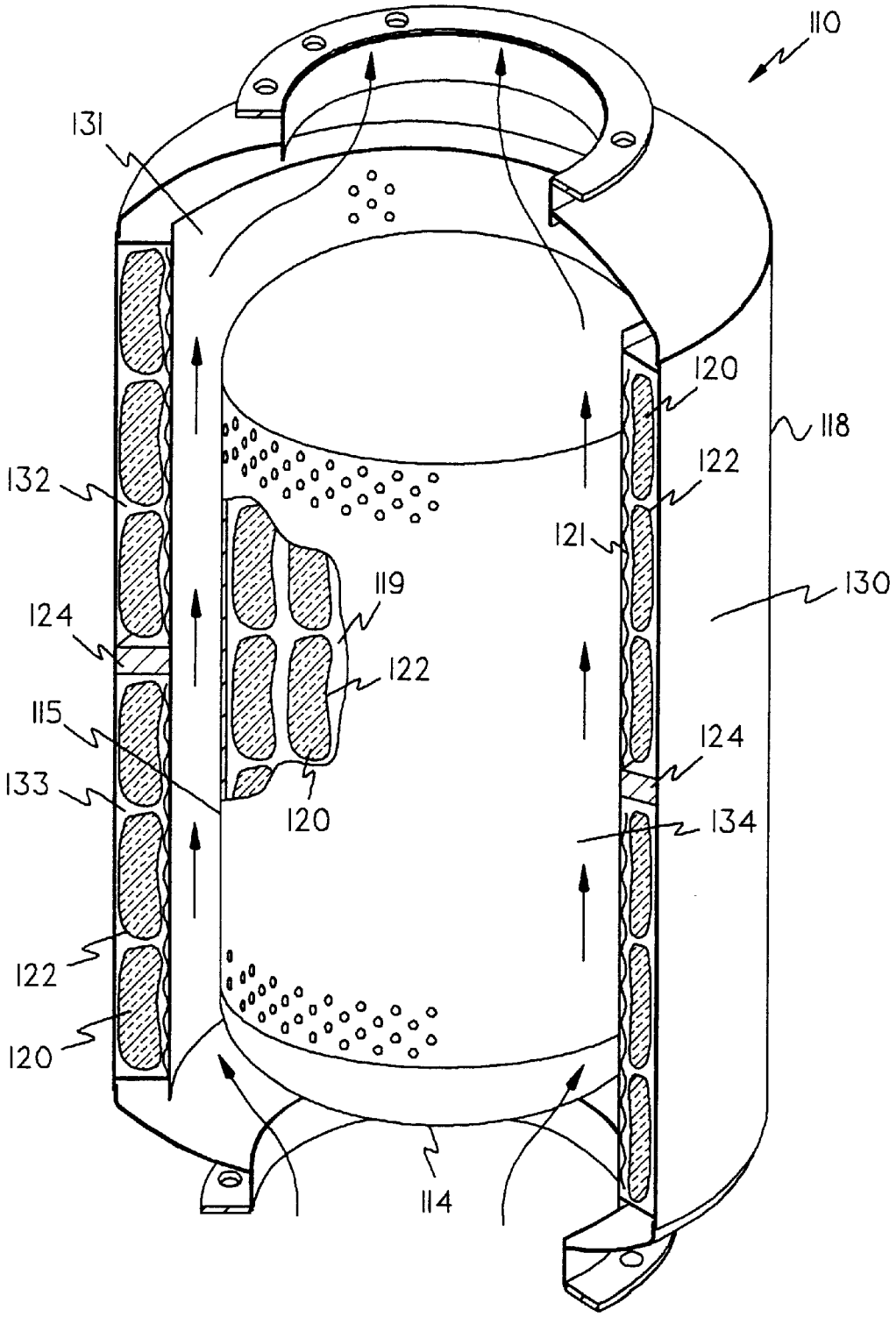
Fig-1 (Prior Art)
FIG. 1 is a partially sectioned perspective view of a typical prior art industrial silencer assembly for high velocity—high temperature applications.

At the outset, it should be clearly understood that like reference numerals are intended to identify the same structural elements, portions or surfaces consistently throughout the several drawing figures. as such elements, portions or surfaces may be further described or explained by the entire written specification, of which this detailed description is an integral part. Unless otherwise indicated, the drawings are intended to be read together with the specification, and are to be considered a portion of the entire "written description" of this invention.

FIG. 1 illustrates a typical prior art industrial silencer 110. The silencer generally comprises a housing 118 having an inner core 114. The housing is bounded by an outer cylindrical wall 130 and an inner perforated cylindrical wall 131 that, together, define an annular chamber 36 (shown in FIG. 3). The annular chamber is subdivided into upper annular space 132 and lower annular space 133 by steel washer/barrier 124. A plurality of packs 122 filled with acoustic material 120 are shown enclosed in both the upper and lower annular spaces. Each pack typically is filled with a material such as mineral, or fiberglass, wool that consists of a collection of small individual fibers. The packs are then individually wrapped in a protective fiberglass cloth. Stainless steel mesh wire 121 is positioned between the packs and inner wall 131 in an attempt to keep the individual fibers and the packs themselves (as they fragment) from being sucked into the gas stream.

The prior art silencer also includes a core barrier 114 which includes an outer perforated wall 134. The core also contains a plurality of packs 122 in space 119 which contain absorptive acoustic material 120. The core functions to dissipate the lower frequency sound waves, while the higher frequency sound waves are absorbed by the acoustic material packed between the perforated cylinder and the outer shell of the unit, as gas flows through the unit as indicated by the arrows in the drawing.

While the above-described design has proven effective for noise reduction, a problem often occurs due to the high velocity and temperatures specific to certain silencing applications. The typical absorptive material used for these applications often fragments due to the extreme gas velocity and temperature. There is thus a risk that the fragmented material will be expelled through the perforated holes into the gas stream. This fragmentation also results in a pack density much higher than intended, which can reduce the absorptive quality of the pack material. Finally, the fragmentation leads to a collapse of the material which leaves voids in the cavity that allow sound waves to pass through freely.

Applications involving high velocity—high temperature gas flows such as gas turbine engine silencers have always been vulnerable to pack migration as well. The common solution has been to modify the internal design of the unit and insert physical barriers (such as 121) to prevent the pack material from migrating or being expelled from the cavity. While this method has been successful in preventing the migration of the pack, the pack material is still vulnerable to fragmentation. The resulting "voids" in the cavity along with other changes in the internal design to reduce migration can affect the performance of the unit, which is critical when silencing a gas turbine engine.

Figure 2:
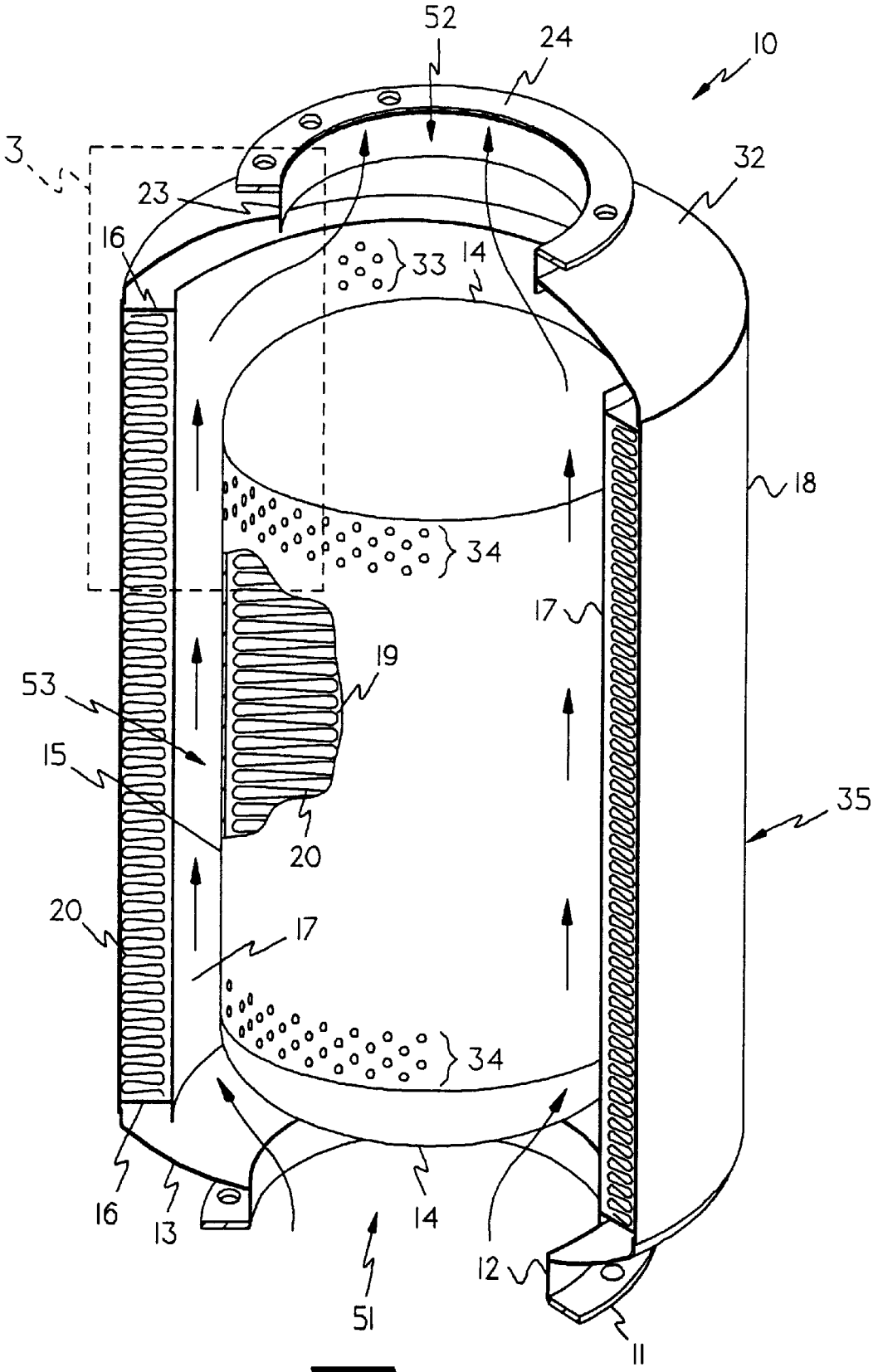
FIG. 2 is a partially sectioned perspective view of the silencer assembly of the present invention.

The present invention uniquely solves these problems as illustrated in FIG. 2, which illustrates an improved industrial silencer unit 10. Silencer 10 generally comprises cylindrically shaped housing 35 having an outer cylindrically shaped wall 18, first end wall 13, and second end wall 32. Inner perforated cylindrically shaped wall 17 is spaced apart from outer wall 18 to form internal annular shaped chamber 36 (shown in FIG. 3). The internal annular chamber is also bounded by annular members 16. Inner wall 17 contains a plurality of perforations, some of which are shown as reference number 33 in FIG. 2. The inner wall actually contains many more perforations than shown in FIG. 2, but they have been omitted from the drawing for ease in understanding the invention. A single strand fiberglass acoustic material 20 is positioned within internal annular chamber 36. It should be appreciated that the design of the present invention obviates the need for a wire mesh barrier between the acoustic material and inner wall 17 (analogous to wire mesh 121 shown in FIG. 1). It also obviates the need for a barrier such as barrier 124 shown in FIG. 1.

Housing 35 is secured to mounting flange 11 by cylindrical member 12, which defines inlet 51. Similarly, cylindrical member 23 secures the chamber to mounting flange 24, and defines outlet 52.

Silencer 10 also includes perforated generally cylindrically shaped core 14 located inside of cylindrical housing 35 and positioned in spaced relation to the internal annular chamber and also in spaced relation to inlet 51 and outlet 52, creating a generally annular shaped passageway 53 for exhaust gas. The core also contains single strand fiberglass acoustic fill material 20 and contains internal physical barriers separating the single strand fiberglass acoustic fill material. Moreover, there is no need for a mesh wire screen positioned between the acoustic material and outer wall 15 of core 14 as in prior art designs.

Figure 3:
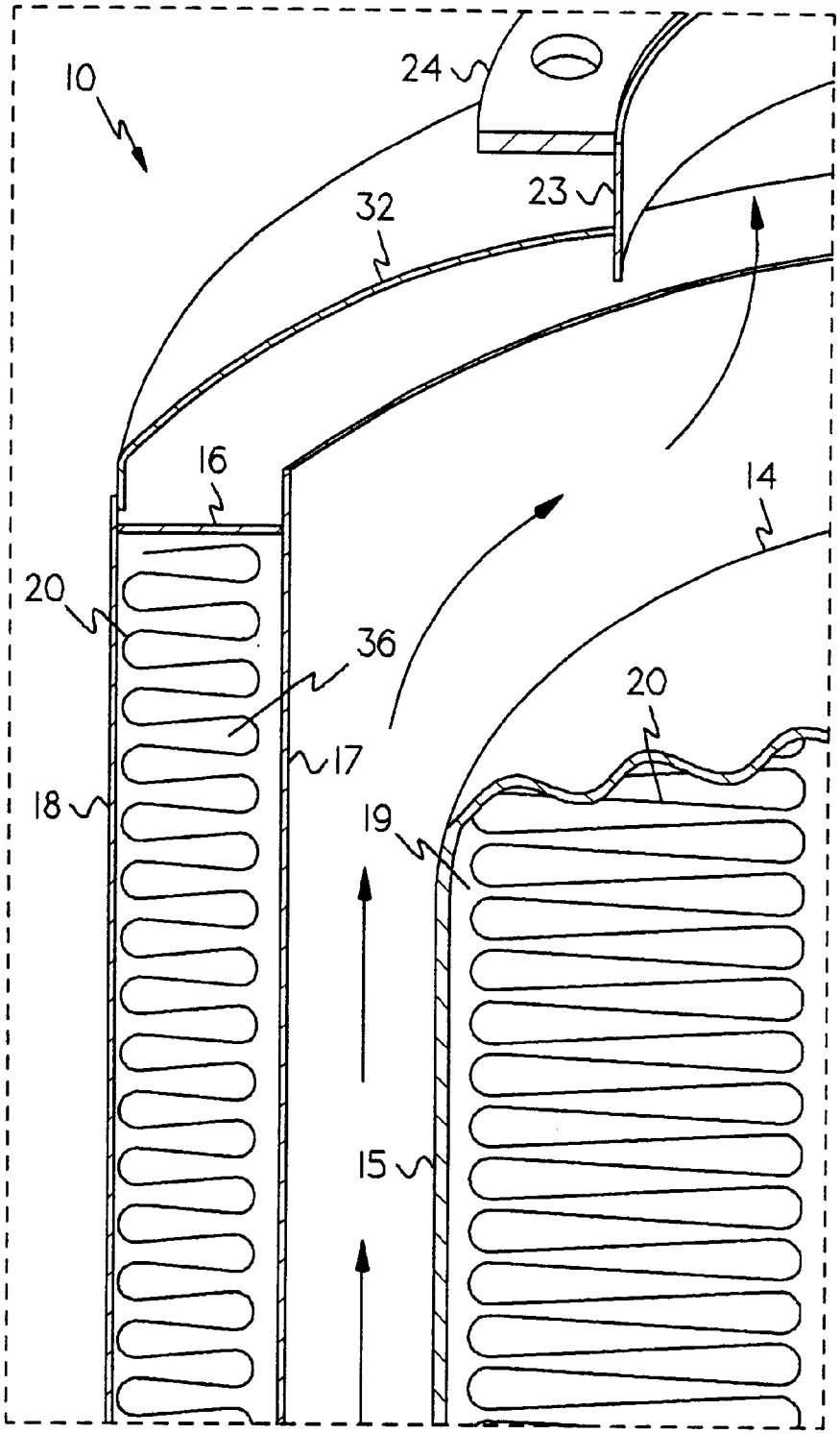
FIG. 3 is partially sectioned perspective view of section 3 of the silencer assembly shown in FIG. 2.
Figure 4:
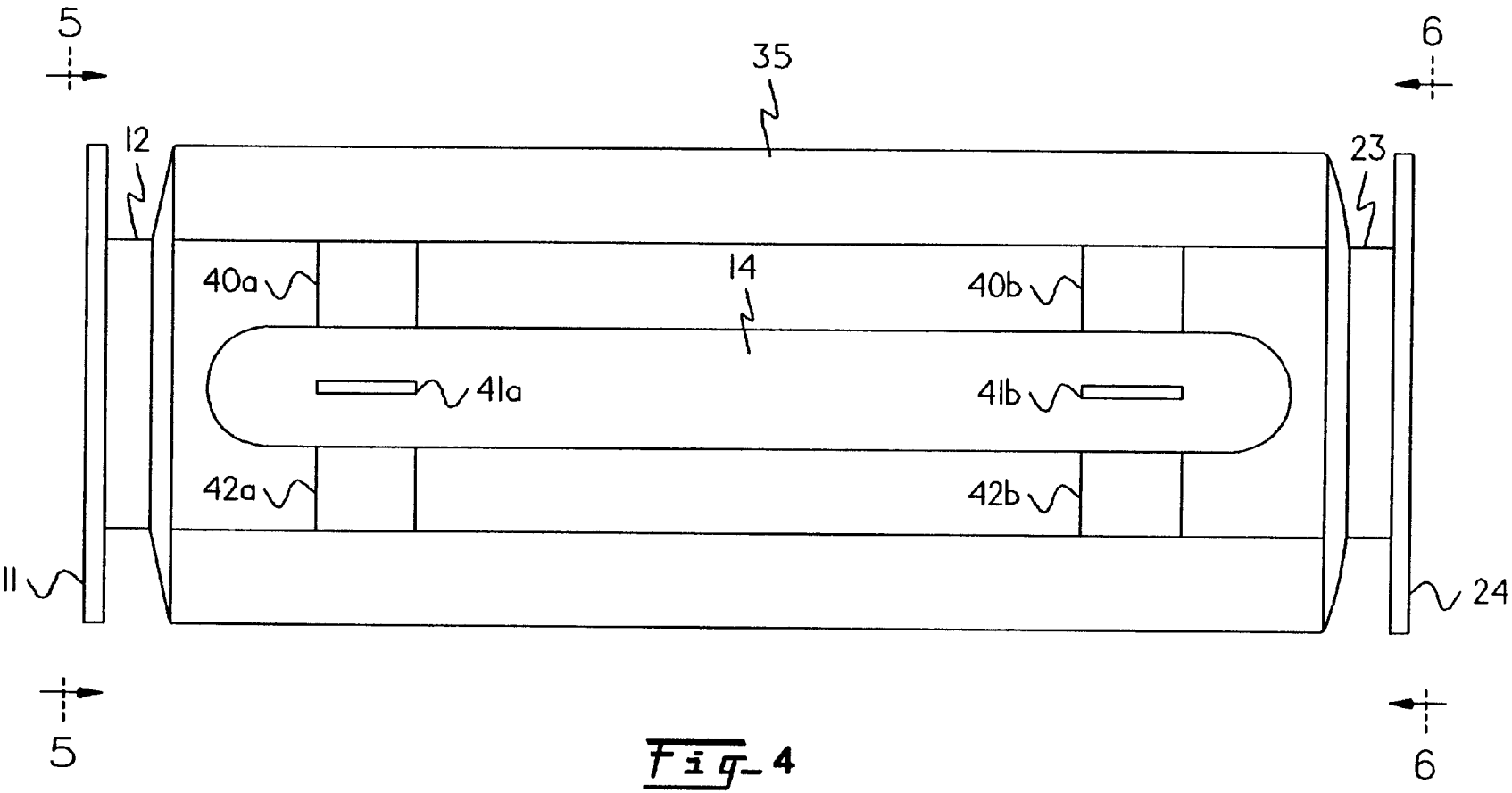
FIG. 4 is a schematic view of the silencer assembly of the present invention, illustrating how the core is sec d within the housing of the silencer.
Figure 6:
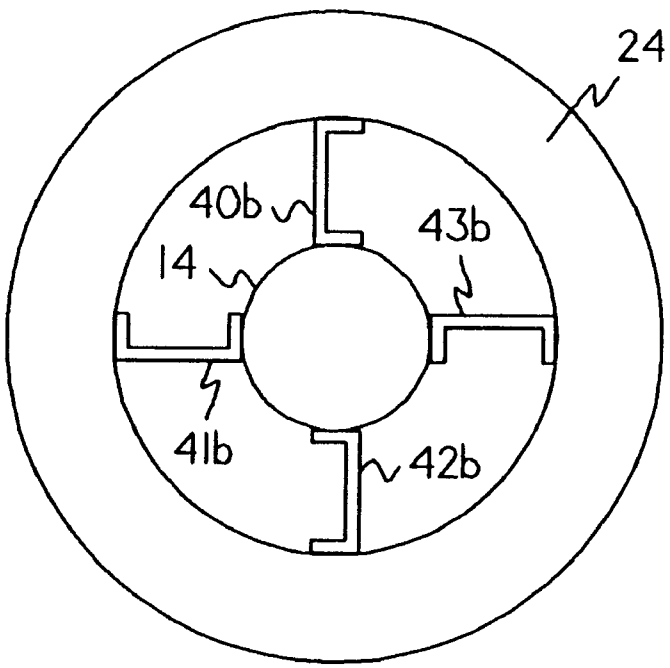
FIG. 6 is an end view of the silencer of the invention, taken generally along line 6—6 in FIG. 4.
Figure 5:
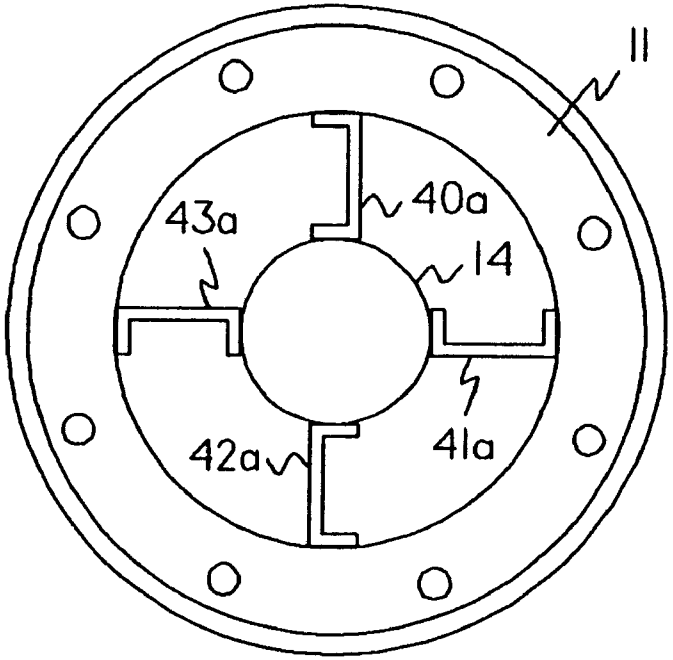
FIG. 5 is an end view of the silencer of the invention, taken generally along line 5—5 in FIG. 4.
Figure 7:
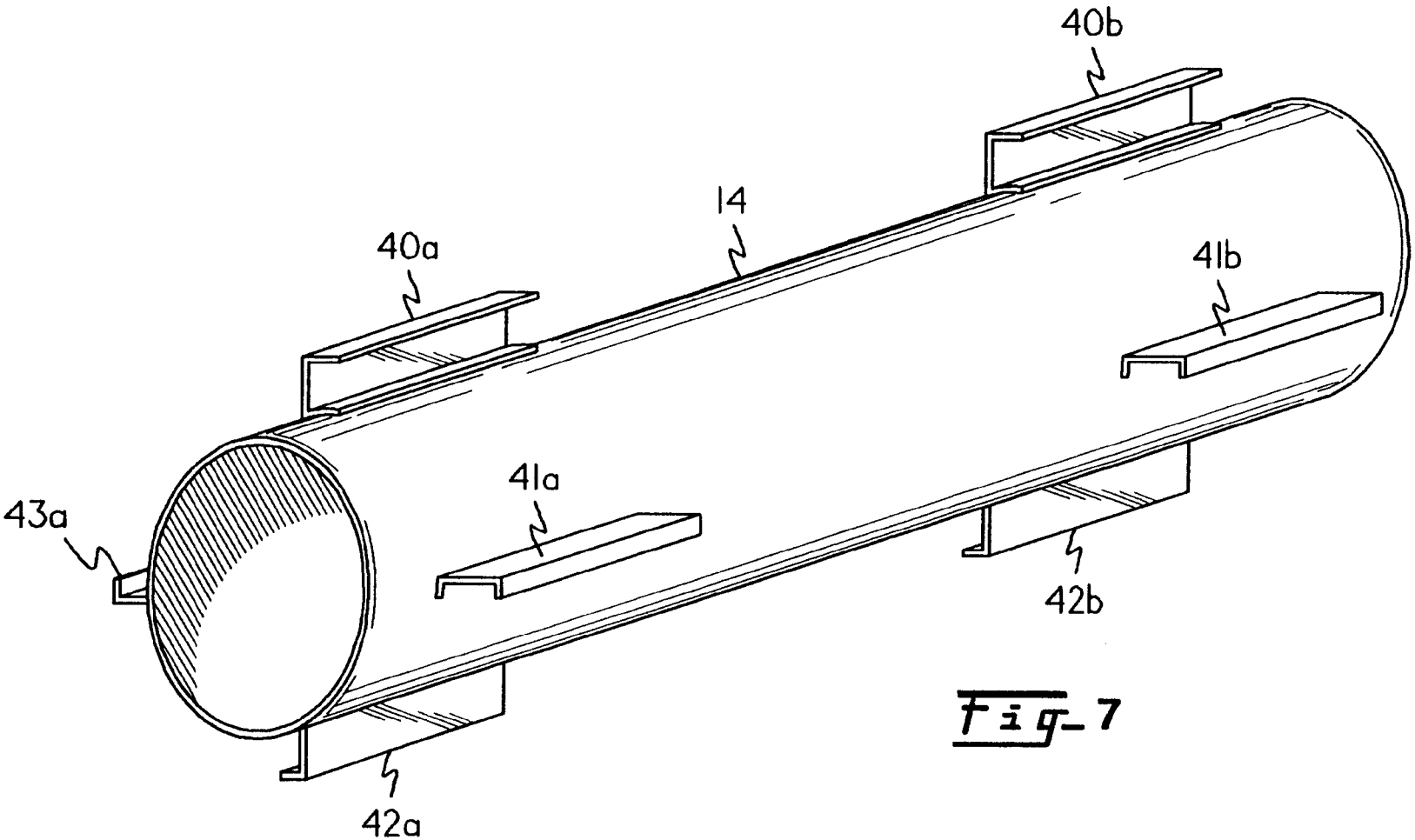
FIG. 7 is a perspective view of core 14 illustrating the mounting brackets which attach the core to the housing.

FIG. 3 is a partially sectioned perspective view of section 3 of the silencer assembly shown in FIG. 2. This drawing figure shows annular chamber 36 filled with single strand acoustic material in more detail. It also shows acoustic material 20 in inner core 14.

The silencer assembly of the present invention is shown in schematic view in FIGS. 4–7 to illustrate how core 14 is secured within housing 35. As seen in the various drawing figures, channel type support brackets 40*a,* 41*a,* 42*a,* and 43*a* at the inlet end; and 40*b,* 41*b,* 42*b,* and 43*b* at the outlet end, function to hold the inner core in place in the chamber. In a preferred embodiment, support brackets 40*b,* 41*b,* 42*b,* and 43*b* are welded in inner wall 17 at the outlet end of the silencer, and support brackets 40*a,* 41*a,* 42*a,* and 43*a* are positioned against inner wall 17 in a slip fit arrangement. It should be appreciated that, although the embodiment shown employs four support brackets about the periphery of the core at each end, the invention would function suitably with more or fewer brackets.

Thus, the objects of the invention are efficiently obtained. Although the above description is directed to a combination absorptive/reactive type silencer, the single strand technology described herein is not intended to be so limited. The invention described herein is particularly useful in applications where the velocity of the gas stream through the silencer is greater than 10,000 feet per minute and the temperature of the gas is greater than 700° F., typical operating conditions when designing for high-pressure steam vent safety relief valve silencers and gas turbine engine silencers, although the invention would be useful in other applications as well. In summary, although the invention is described by reference to specific preferred embodiments, it is clear that variations can be made without departing from the spirit of the invention as claimed.

What is claimed is:

1. A silencer assembly, comprising:

a cylindrical chamber having a closed cylindrical outer wall, a first end wall and a second end wall, said first end wall having an inlet therein, and said second end wall having an outlet therein;

an internal annular chamber proximate said cylindrical outer wall, said internal annular chamber bounded by said cylindrical outer wall and by a perforated cylindrical inner wall, said internal annular chamber containing single strand fiberglass acoustic fill material, said internal annular chamber having no internal barriers separating said single strand fiberglass acoustic fill material; and, a perforated generally cylindrically shaped core located inside of said cylindrical chamber positioned in spaced relation to said internal annular chamber and also in spaced relation to said inlet and outlet, creating a generally annular shaped passageway for exhaust gas, said core containing single strand fiberglass acoustic fill material and having no internal physical barriers separating said single strand fiberglass acoustic fill material.

2. A silencer assembly, comprising:

a cylindrical chamber having a closed cylindrical outer wall, a first end wall and a second end wall, said first end wall having an inlet therein, and said second end wall having an outlet therein;

an internal annular chamber proximate said cylindrical outer wall, said internal annular chamber bounded by said cylindrical outer wall and by a perforated cylindrical inner wall, said, internal annular chamber containing acoustic fill material; and, a perforated generally cylindrically shaped core located inside of said cylindrical chamber positioned in spaced relation to said internal annular chamber and also in spaced relation to said inlet and outlet, creating a generally annular shaped passageway for exhaust gas, said core containing single strand fiberglass acoustic fill material and having no internal physical barriers separating said single strand fiberglass acoustic fill material.

3. A silencer assembly, comprising:

a cylindrical chamber having a closed cylindrical outer wall, a first end wall and a second end wall, said first end wall having an inlet therein, and said second end wall having an outlet therein;

an internal annular chamber proximate said cylindrical outer wall, said internal annular chamber bounded by said cylindrical outer wall and by a perforated cylindrical inner wall, said internal annular chamber containing single strand fiberglass acoustic fill material, said internal annular chamber having no internal barriers therein; and, a perforated generally cylindrically shaped core located inside of said cylindrical chamber positioned in spaced relation to said internal annular chamber and also in spaced relation to said inlet and outlet, creating a generally annular shaped passageway for exhaust gas, said core containing acoustic fill material.

4. A silencer assembly, comprising:

a cylindrical chamber having a closed cylindrical outer wall, a first end wall and a second end wall, said first end wall having an inlet therein, and said second end wall having an outlet therein;

an internal annular chamber proximate said cylindrical outer wall, said internal annular chamber bounded by said cylindrical outer wall and by a perforated cylindrical inner wall, said internal annular chamber containing single strand acoustic fill material, said internal annular chamber having no internal barriers separating said single strand acoustic fill material; and, a perforated generally cylindrically shaped core located inside of said cylindrical chamber positioned in spaced relation to said internal annular chamber and also in spaced relation to said inlet and outlet, creating a generally annular shaped passageway for exhaust gas, said core containing single strand acoustic fill material and having no internal physical barriers separating said single strand acoustic fill material.

* * * * *